US010518122B2

(12) United States Patent
Ratajac

(10) Patent No.: US 10,518,122 B2
(45) Date of Patent: Dec. 31, 2019

(54) EXERCISE DEVICE

(71) Applicant: Aleksandar Ratajac, San Diego, CA (US)

(72) Inventor: Aleksandar Ratajac, San Diego, CA (US)

( * ) Notice: Subject to any disclaimer, the term of this patent is extended or adjusted under 35 U.S.C. 154(b) by 109 days.

(21) Appl. No.: 15/703,517

(22) Filed: Sep. 13, 2017

(65) Prior Publication Data

US 2019/0076690 A1 Mar. 14, 2019

(51) Int. Cl.

| | |
|---|---|
| ***A63B 21/02*** | (2006.01) |
| ***A63B 21/00*** | (2006.01) |
| ***A63B 23/04*** | (2006.01) |
| ***A63B 23/12*** | (2006.01) |
| ***A63B 21/05*** | (2006.01) |
| ***A63B 23/16*** | (2006.01) |
| ***A63B 23/02*** | (2006.01) |
| ***A63B 23/035*** | (2006.01) |

(52) U.S. Cl.

CPC ..... *A63B 21/02* (2013.01); *A63B 21/00043* (2013.01); *A63B 21/025* (2013.01); *A63B 21/026* (2013.01); *A63B 21/05* (2013.01); *A63B 21/4035* (2015.10); *A63B 21/4043* (2015.10); *A63B 23/0233* (2013.01); *A63B 23/0355* (2013.01); *A63B 23/04* (2013.01); *A63B 23/0488* (2013.01); *A63B 23/12* (2013.01); *A63B 23/1209* (2013.01); *A63B 23/16* (2013.01); *A63B 2209/00* (2013.01)

(58) Field of Classification Search

CPC ..... A63B 21/02; A63B 23/16; A63B 21/4043; A63B 21/025; A63B 23/0355; A63B 21/05; A63B 23/12; A63B 23/0233; A63B 23/04; A63B 21/4035; A63B 2209/00; A63B 21/028; A63B 21/00185; A63B 21/00189

See application file for complete search history.

(56) References Cited

U.S. PATENT DOCUMENTS

| | | | | |
|---|---|---|---|---|
| 2,529,347 | A | 11/1950 | Mohler | |
| 3,559,988 | A | 2/1971 | Greenless | |
| 4,023,808 | A | 5/1977 | Hebert | |
| 4,169,590 | A | 10/1979 | Johansen | |
| 4,210,323 | A * | 7/1980 | Feather | A63B 21/0004 482/122 |
| 4,465,276 | A * | 8/1984 | Cox | A63B 21/0004 482/126 |
| 4,483,533 | A | 11/1984 | Mangiapane | |
| 4,753,434 | A * | 6/1988 | Salvino | A63B 23/16 482/121 |
| 4,861,022 | A | 8/1989 | Boatcallie | |
| 5,026,050 | A | 6/1991 | Leung | |
| 5,230,679 | A | 7/1993 | Olsen | |
| D341,401 | S | 11/1993 | Reichman | |

(Continued)

*Primary Examiner* — Andrew S Lo
(74) *Attorney, Agent, or Firm* — TMB Law

(57) ABSTRACT

A portable exercise device for exercising the muscles of the upper body and thighs. The device comprises a pair of elongate members having a body engaging element for receiving the thighs of the user to hold the device in a stable, fixed position, a spring portion that joins the elongate members in a generally parallel configuration, and optionally a pair of handgrips at the ends of the elongate members. Methods of using the device of the invention are also provided.

20 Claims, 19 Drawing Sheets

(56) References Cited

U.S. PATENT DOCUMENTS 5,267,929 A * 12/1993 Chen ..... A63B 21/00043 482/122
5,399,138 A 3/1995 Jones
D365,395 S 12/1995 Miyauchi
D367,901 S 3/1996 Real
5,507,712 A * 4/1996 Chang ..... A63B 21/0004 482/126
5,514,058 A * 5/1996 Buoni ..... A63B 21/0004 482/124
5,674,164 A 10/1997 Kravitz
5,690,596 A * 11/1997 Parker ..... A63B 21/0004 482/121
5,713,822 A * 2/1998 Newman ..... A63B 21/0004 482/121
5,720,701 A 2/1998 Truini
5,720,702 A 2/1998 Lee
5,755,649 A 5/1998 Bimby
5,897,471 A 4/1999 Multanen
5,899,837 A * 5/1999 Chen ..... A63B 21/00043 482/126
5,967,953 A 10/1999 Nunez
5,980,436 A 11/1999 Cheng
6,080,090 A * 6/2000 Taylor ..... A63B 21/0455 482/121
D427,651 S 7/2000 Bodman
D428,631 S * 7/2000 Stein ..... D21/662
6,193,637 B1 2/2001 Corbin
6,224,525 B1 * 5/2001 Stein ..... A63B 21/026 482/121
6,254,517 B1 7/2001 Kennedy
D446,561 S 8/2001 Beard
6,743,159 B1 * 6/2004 Taylor ..... A63B 21/0004 482/121
6,786,849 B1 * 9/2004 Faulconer ..... A63B 21/0004 482/121
6,872,174 B2 3/2005 Benach
7,077,787 B1 * 7/2006 Wiesman ..... A63B 21/025 482/127
7,285,079 B2 10/2007 Mandell
7,291,101 B2 11/2007 Deal
D591,367 S * 4/2009 Harris ..... A63B 21/00043 D21/684
7,652,953 B1 1/2010 Fluegge
D617,856 S * 6/2010 Brinser ..... D21/662
7,828,704 B1 * 11/2010 Hsieh ..... A63B 21/0004 482/121
D634,795 S * 3/2011 Holleman ..... A63B 21/0004 D21/679
8,167,780 B2 * 5/2012 Allen ..... A63B 21/0004 482/126
D671,179 S 11/2012 Chang
8,556,786 B2 * 10/2013 Chen ..... A63B 21/0004 482/122
8,777,821 B2 7/2014 Lando
9,211,430 B1 * 12/2015 Higginbotham, III ..... A63B 21/0004
9,757,606 B2 * 9/2017 Hao ..... A63B 21/023
D810,844 S 2/2018 Hao
D827,734 S 9/2018 Exley
2008/0051271 A1 2/2008 Mandell
2011/0201483 A1 8/2011 Holleman
2012/0178600 A1 7/2012 Chen
2012/0264577 A1 * 10/2012 Dennis ..... A63B 21/0557 482/126
2013/0005542 A1 * 1/2013 Wu ..... A63B 21/05 482/128
2013/0065740 A1 * 3/2013 Francis ..... A63B 21/0004 482/122
2014/0113771 A1 * 4/2014 Kubik ..... A63B 23/03 482/11
2016/0129297 A1 * 5/2016 Dennis ..... A63B 21/02 482/126
2017/0319890 A1 * 11/2017 Dennis ..... A63B 21/02
2017/0354842 A1 * 12/2017 Boland ..... A63B 23/0482

* cited by examiner

EXERCISE DEVICE

FIELD OF THE INVENTION

The invention generally relates to an exercise device. More particularly, the invention relates to a portable exercise device for exercising the muscles of the upper body and thighs.

BACKGROUND OF THE INVENTION

Numerous exercise devices are available in the art. For example, U.S. Pat. No. 3,559,988 to Greenless, U.S. Pat. No. 5,897,471 to Multanen et al., and U.S. Pat. No. 5,980,436 to Cheng provide examples of such devices. While these devices may be suitable for the particular purposes that they address, they are not suitable for the purposes met by the present invention.

U.S. Pat. No. 3,559,988 to Greenless is drawn to a portable exercise device for developing the muscles of the wrists, arms and upper body. The device includes a spring having a coiled configuration in its unstressed condition, and a handgrip attached to each end of the spring operable to uncoil the spring upon relative twisting movement between the handgrips. The handgrips can be moved linearly toward and away from each other against the resistance of a spring force between the handgrips. While Greenless' device is portable and capable of exercising the wrists, arms and upper body, it is incapable of exercising the thigh muscles.

U.S. Pat. No. 5,897,471 to Multanen et al. is drawn to an upper body muscle toner device and leg and knee exerciser comprising a U-shaped flexure member and a pair of handgrips. The device is configured so that so that a person can grasp the handgrips to flex the U-shaped flexure member in and out with arm power to tone the upper body muscles and exercise the legs and knees. While Multanen et al.'s device can exercise the upper body muscles, legs and knees, it lacks a stabilizing feature for holding the device against the user when exercising the thighs. As a result, the device has a tendency to twist and slide while the user adducts and abducts the thighs making it difficult to maintain the device in a useable position.

U.S. Pat. No. 5,980,436 to Cheng is drawn to a thigh exerciser comprising a primary elongated member made of resilient material, two curved supporters engaged with two ends of the primary elongated member, a secondary elongated member detachably fitted in the primary elongated member, and two straps each extending through two slots of each of the curved supporters. While Cheng's device can be used to strengthen the thigh muscles, its application in exercising the upper body muscles is limited. In addition, Cheng's device comprises a linear member that is compressed into a curved formation by adducting the user's legs. Thus, Cheng's device is incapable of providing resistance to the abduction of the user's legs in exercising the outer thigh muscles.

What is needed in the art is a portable device that can exercise the muscles of the upper body and thighs while maintaining a stable, fixed position when used to exercise the thighs.

SUMMARY OF THE INVENTION

A primary object of the present invention is to provide a portable exercise device for exercising the muscles of the upper body and thighs, wherein the device is capable of maintaining a stable fixed position while being manipulated to exercise the thigh muscles.

A further object of the invention is to provide an exercise device comprising a pair of elongate members that are joined and held opposite one another in a generally parallel configuration by an intervening spring portion that provides resistance to the movement of the elongate members towards and away from one another.

A further object of the invention is to provide a body engaging element that is fixed to the elongate members and configured to hold the exercise device against the thighs of the user as the user adducts or abducts the thighs against the resistive force of the spring portion.

Yet another object of the invention is to provide a pair of handgrips that are fixed to the ends of the elongate members and are configured to permit the user to grip and flex the device in exercising the upper body muscles, including the muscles of the chest, shoulders, back, arms, and hands.

Other objects, advantages, purposes and features of the invention will be apparent to one skilled in the art in view of the following detailed description and accompanying drawings.

BRIEF DESCRIPTON OF THE DRAWINGS

Various other objects, features and attendant advantages of the present invention will become more fully appreciated when considered in conjunction with the accompanying drawings, in which like reference characters designate the same or similar parts throughout the several views of the drawings and the accompanying detailed description.

Figure 19A:
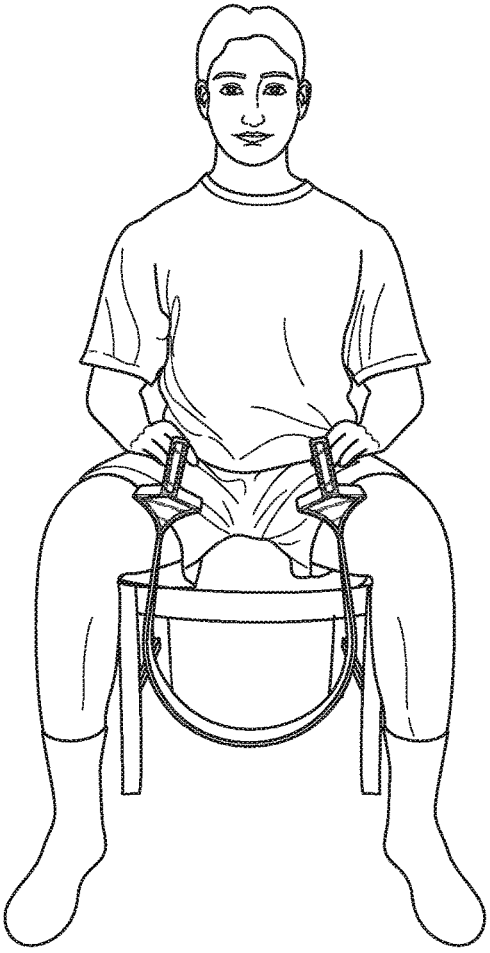
Figure 19B:
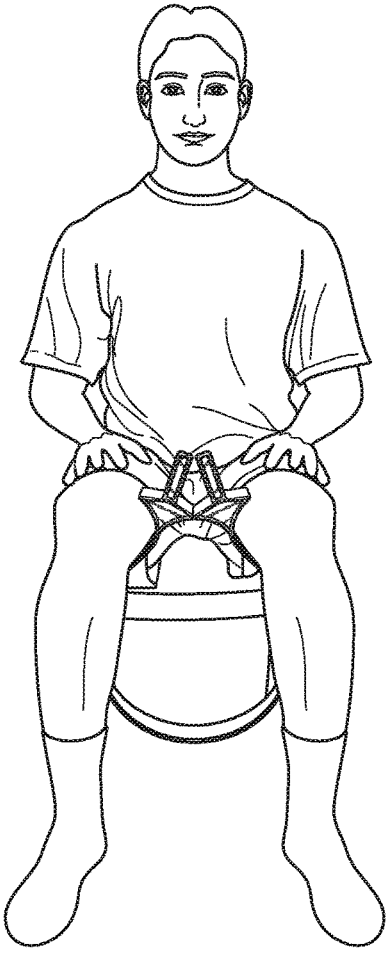

FIGS. 19A-B show a method of using the inventive device in exercising the inner thigh muscles. FIG. 19A shows the device in a slightly compressed configuration thereby holding the device in position between the thighs of the user in a seated position. FIG. 19B shows the user compressing the device by adducting his legs in a seated position.

Figure 20A:
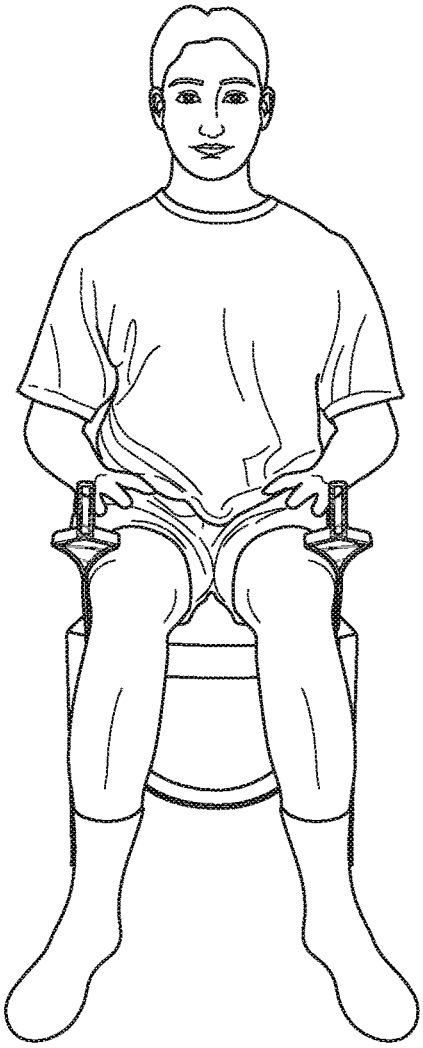
Figure 20B:
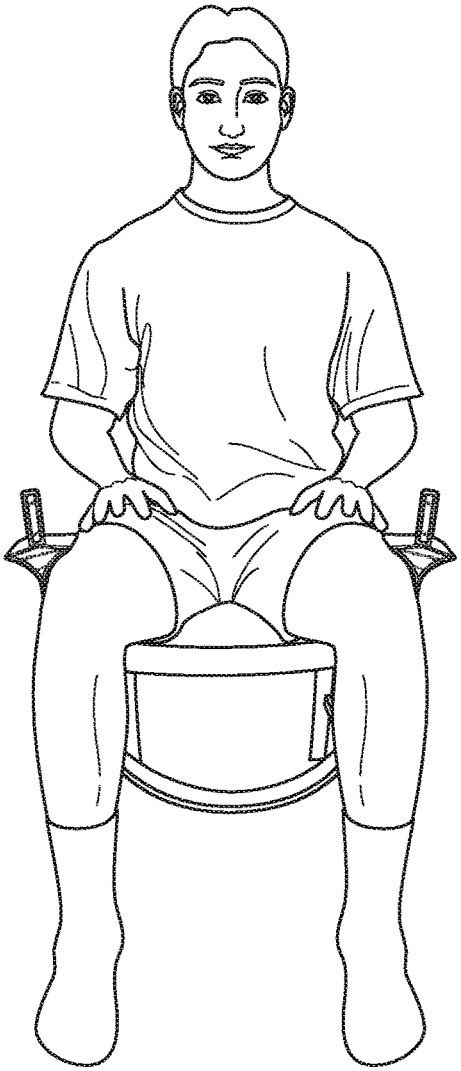

FIGS. 20A-B show a method of using the inventive device in exercising the outer thigh muscles. FIG. 20A shows the device in contact with the outer thighs of the user in a seated position. FIG. 20B shows the user expanding the device by abducting his legs in a seated position.

Figure 21C:
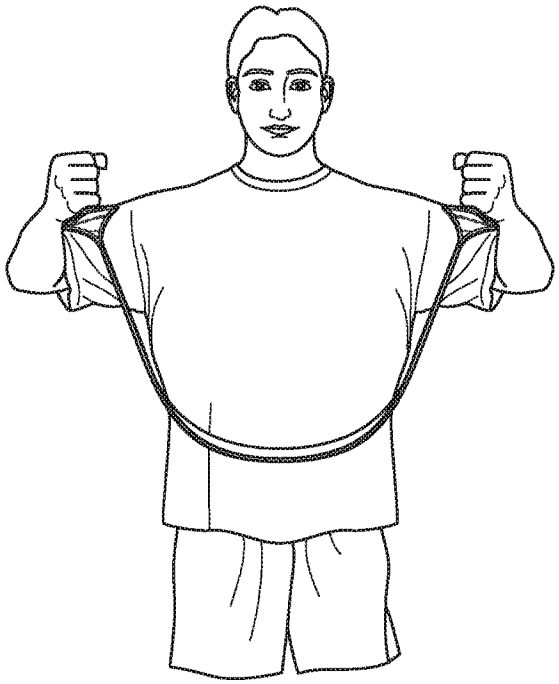
Figure 21B:
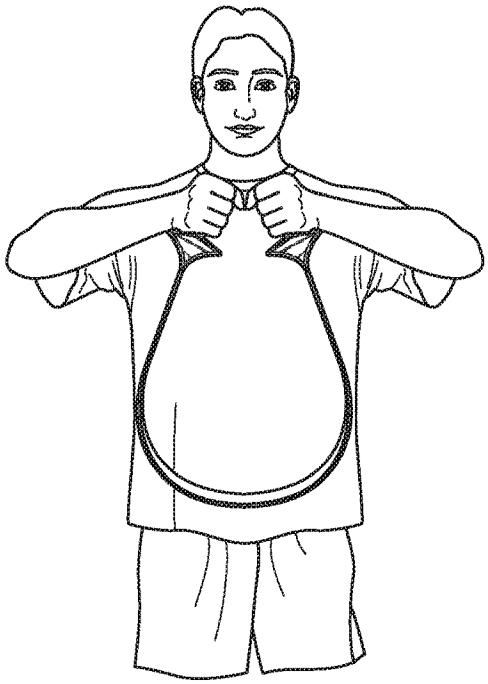
Figure 21A:
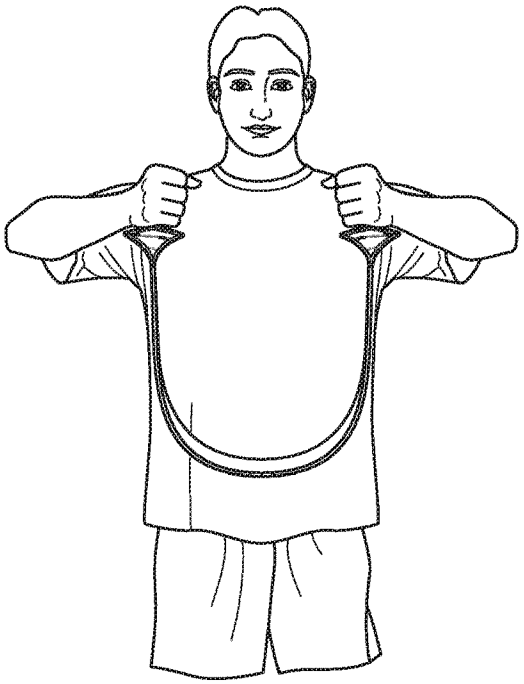

FIGS. 21A-C show a method of exercising the muscles of the chest, shoulders, back, arms and hands using the inventive device in front of the chest of the user. FIG. 21A shows the device in contact with the hands of the user in an unstressed state. FIG. 21B shows the user compressing the device. FIG. 21C shows the user expanding the device.

Figure 22C:
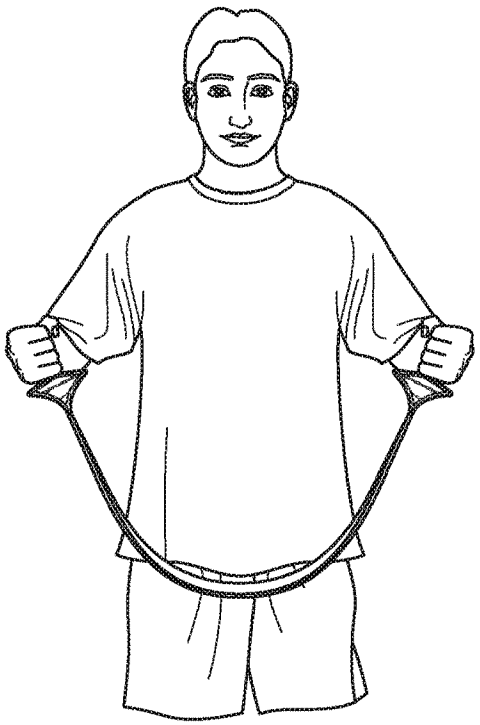
Figure 22B:
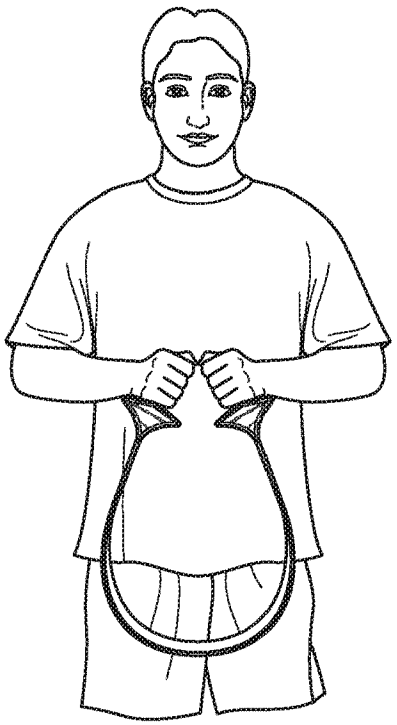
Figure 22A:
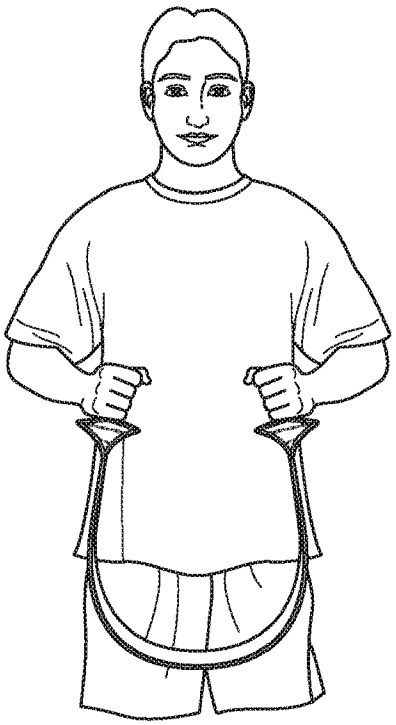

FIGS. 22A-C show a method of exercising the muscles of the chest, shoulders, back, arms and hands using the inventive device in front of the abdomen of the user. FIG. 22A shows the device in contact with the hands of the user in an unstressed state. FIG. 22B shows the user compressing the device. FIG. 22C shows the user expanding the device.

Figure 23C:
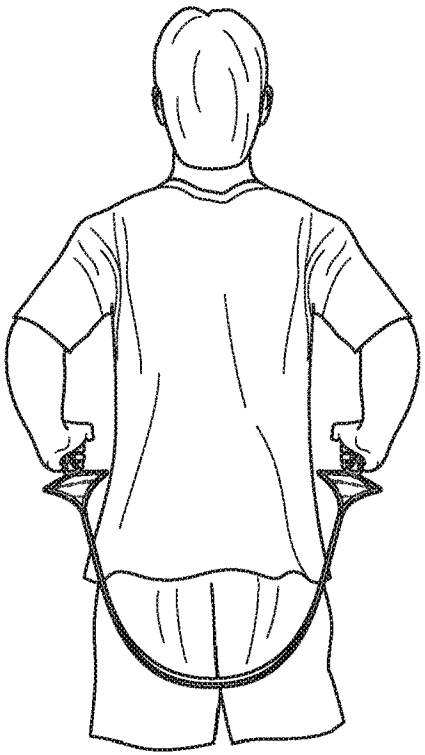
Figure 23B:
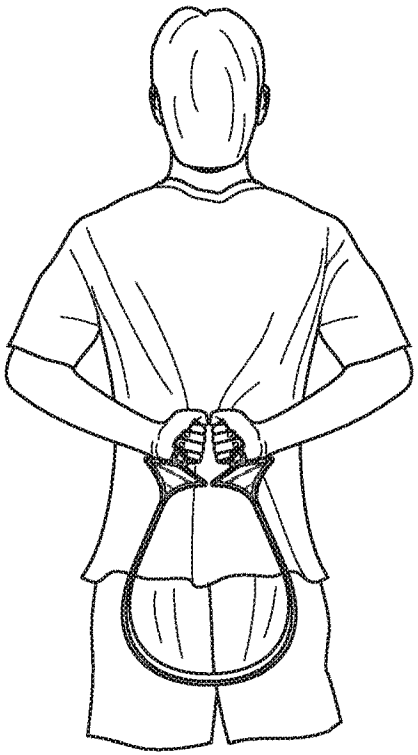
Figure 23A:
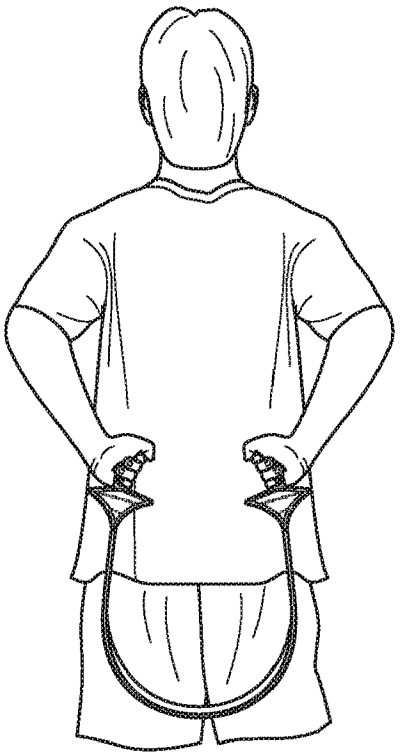

FIGS. 23A-C show a method a method of exercising the muscles of the shoulders, back, arms and hands using the inventive device behind the back of the user. FIG. 23A shows the device in contact with the hands of the user in an unstressed state. FIG. 23B shows the user compressing the device. FIG. 23C shows the user expanding the device.

Figure 24C:
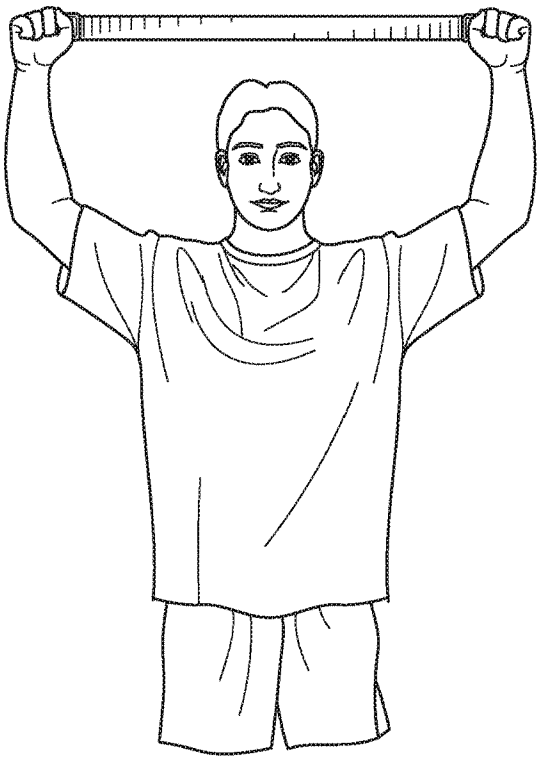
Figure 24B:
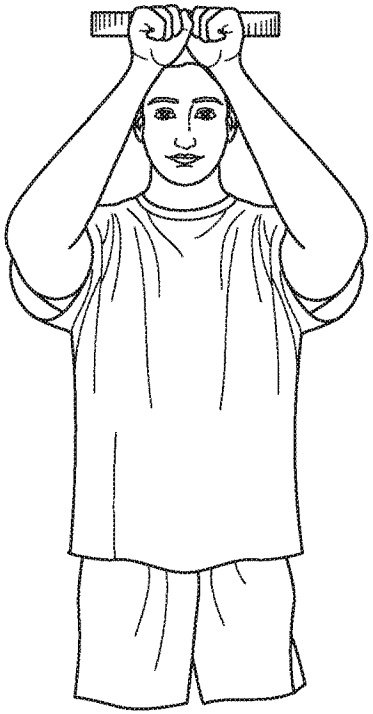
Figure 24A:
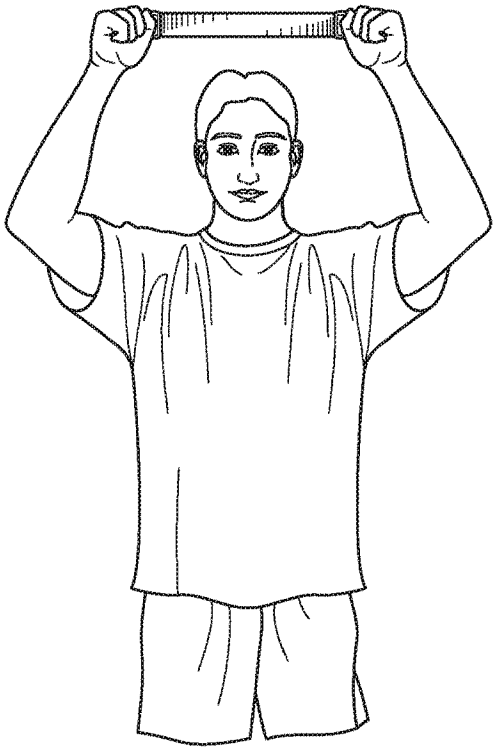

FIGS. 24A-C show a method of exercising the muscles of the chest, shoulders, back, arms and hands using the inventive device over the head of the user. FIG. 24A shows the device in contact with the hands of the user in an unstressed state. FIG. 24B shows the user compressing the device. FIG. 24C shows the user expanding the device.

DETAILED DESCRIPTION

Figure 1:
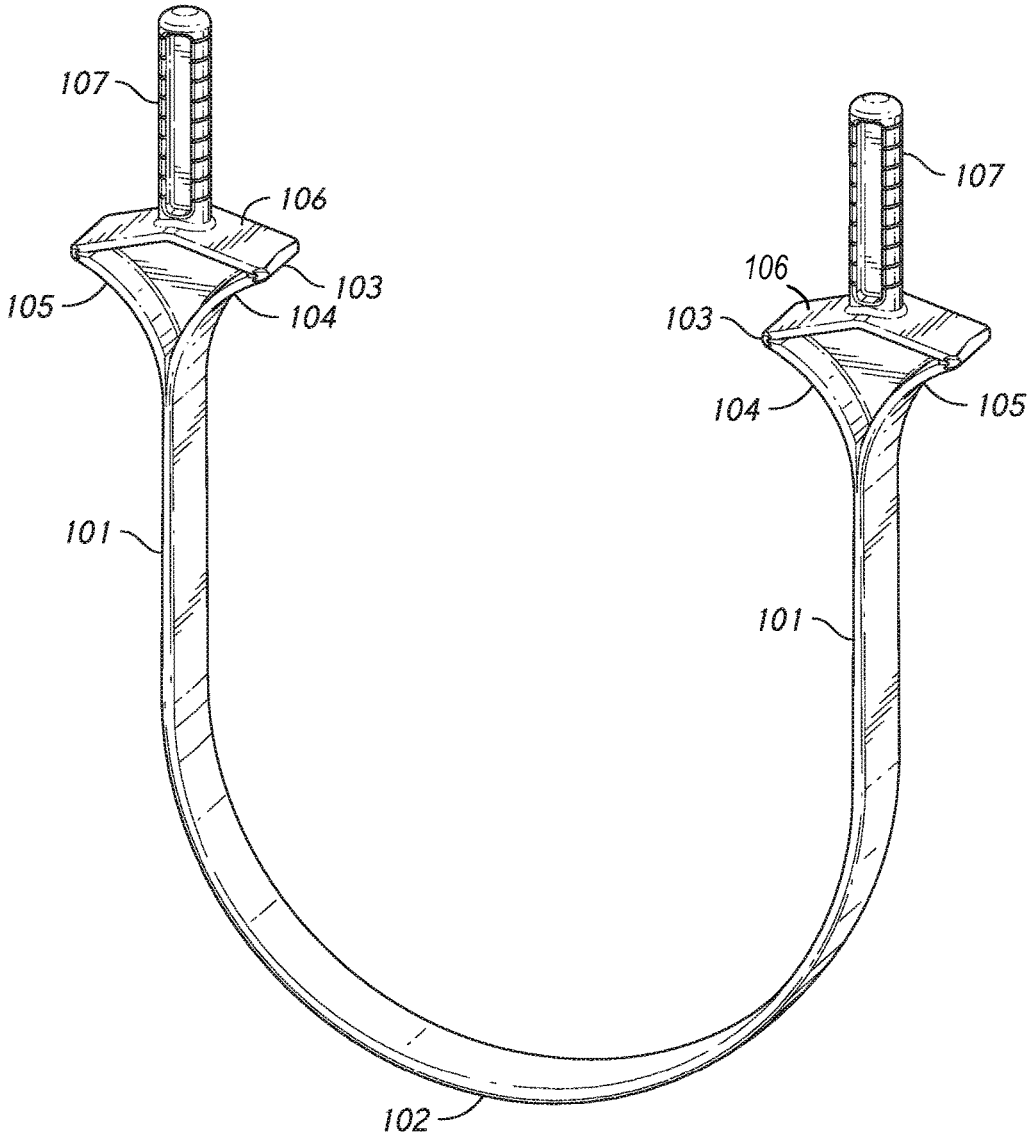
FIG. 1 is a perspective view of an embodiment of the inventive device in an unstressed state.
Figure 2:
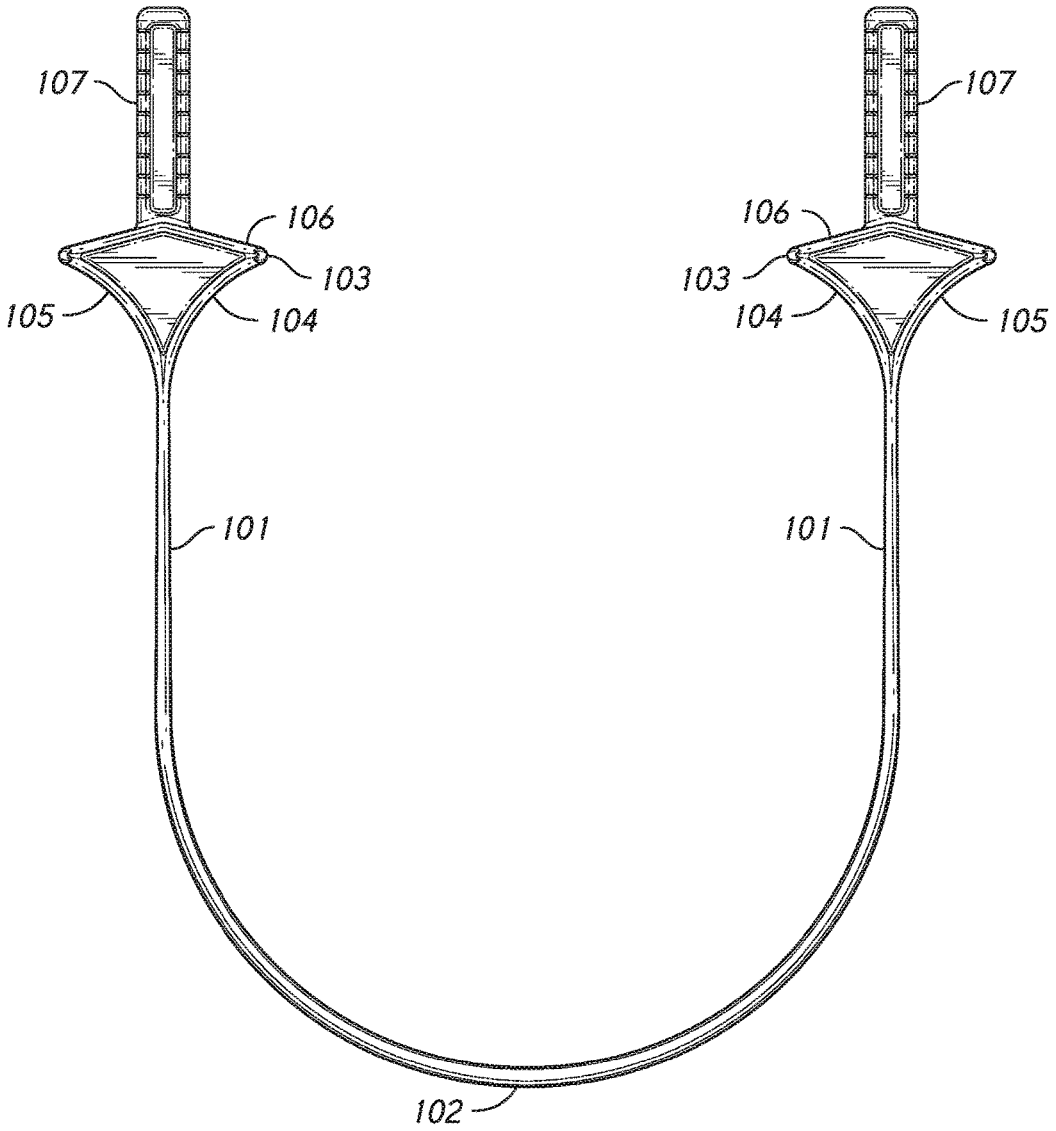
FIG. 2 is an elevational view of an embodiment of the inventive device in an unstressed state.

FIG. 1 is a perspective view of an embodiment of the inventive device in an unstressed state wherein elongate members 101 are joined to one another and held in a parallel configuration by spring portion 102. Elongate members 101 can be equal in length and can each comprise body engaging element 103. Body engaging element 103 can assume any configuration that is designed to accept the body portion of a user as the user applies force to flex the device. Body engaging element 103 can assume a size and shape suitable for accepting the user's thighs, knees, calves, ankles, wrists, forearms, and/or upper arms. Body engaging element 103 can comprise inner surface 104 and outer surface 105. Inner surface 104 and outer surface 105 can assume the shape of an arc for accepting the body portion of a user as disclosed herein. Inner surface 104 can assume the shape of an arc for accepting the outer thighs of a user. Outer surface 105 can assume the shape of an arc for accepting the inner thighs of a user. The arc of inner surface 104 and outer surface 105 can have a radius of between about 2 inches and about five inches. The arc of inner surface 104 and outer surface 105 can have a radius of about three inches. Body engaging element 103 can further comprise upper surface 106 for abutting the user's hands while the user's hands engage handgrips 107 thereby providing greater stability in maintaining the device in a desired position while the user flexes the device. Handgrips 107 are elongate and can be generally circular, square, hour-glass or oblong in cross-section. Handgrips 107 can be textured, contoured to accept the fingers of the user, and/or covered with foam, rubber or similar material for providing enhanced grip. In at least one embodiment, the device of the invention omits handgrips 107 such that the upper end of the device terminates at upper surface 106.

Elongate members 101 can assume a generally parallel configuration when the device is in an unstressed state. As used herein, the phrase "generally parallel" means elongate members 101 are parallel to one another, or assume an angle of about +/−1° to about +/−15°, with respect to a central vertical axis of elongate members 101. Elongate members 101 can have a cross-section that is circular, square or oblong. Elongate members 101 can have a cross-section that is rectangular or oval.

In some embodiments, elongate members 101 can be constructed to have greater rigidity than spring portion 102 such that when elongate members 101 are forced towards or away from one another, elongate members 101 resist bending and remain straight while spring portion 102 deforms to provide resistance to such force. In other embodiments, elongate members 101 can be of a resilient construction such that they flex and provide resistive force, against their movement towards and/or away from one another, in addition to the resistance provided by spring portion 102 to such movement. In further embodiments, elongate members 101 and spring portion 102 can provide equal resistance to the movement of elongate members 101 such that the bending stress in elongate members 101 and spring portion 102 is approximately constant under the beam bending theory. Such embodiments can be of a single, continuous construction and have a spring portion 102 with its thickest portion being at its bottom (e.g. at the midline), wherein the thickness of the device tapers progressively along the remainder of spring portion 102 and the length of elongate members 101 to body engaging elements 103. The thickest portion of the bottom of spring portion 102 can be between about 0.25 inches and about 0.80 inches. The thickest portion of the bottom of spring portion 102 can be about 0.38 inches. The thickest portion of the bottom of spring portion 102 can be about 0.46 inches. The thickness of the transition where spring portion 102 joins the bottom of elongate members 101 (i.e. wherein the device assumes a linear configuration) can be between about 0.17 inches and about 0.60 inches. The thickness of the transition can be about 0.30 inches. The thickness of the transition can be about 0.36 inches. The thickness of the top of elongate members 101 where they contact body engaging elements 103 can be between about 0.15 inches and about 0.45 inches. The thickness of the top of elongate members 101 can be about 0.20 inches or about 0.22 inches. The thickness of the top of elongate members 101 can be about 0.26 inches.

Spring portion 102 is generally of a resilient construction to provide resistive force against the movement of elongate members 101 towards and away from one another. The device can be manufactured such that spring portion 102 provides between about 5 pounds and about 40 pounds of resistance at the center of body engaging element 103 at full extension or compression. Spring portion 102 can provide about 5 pounds, about 10 pounds, about 15 pounds, about 20 pounds, about 25 pounds, about 30 pounds, about 35 pounds, or about 40 pounds of resistance at full extension or compression.

The device can be manufactured from any material that permits it to achieve the functions and characteristics disclosed herein. The device can be manufactured from a synthetic material. The synthetic material can comprise polyvinyl chloride (PVC), acrylonitrile-butadiene-styrene (ABS), polypropylene, nylon or combinations thereof. The synthetic material can be selected from the group consisting of polyvinyl chloride (PVC), acrylonitrile-butadiene-styrene (ABS), polypropylene, nylon and combinations thereof. The synthetic materials for manufacturing the device can be impregnated with glass fibers. For example, the synthetic materials can be impregnated with glass fibers to achieve a desired rigidity and level of resistance as disclosed herein. The synthetic materials can comprise between about 10% and about 50% glass fibers by weight. The synthetic materials can comprise between about 20% and about 40% glass fibers by weight. The synthetic materials can comprise, by weight, about 10%, about 15%, about 20%, about 25%, about 30%, about 35%, about 40%, about 45% or about 50% glass fibers. As used herein, the term "about" means an amount that is equal to the stated value to which the term is applied, as well as amounts that are plus or minus 1%, 2%, 3%, 4%, or 5% of the stated value. The length of the glass fibers can be between about 0.05 cm and about 3 cm, as well as any length intervening this range. The length of the glass fibers can be about 0.05 cm, about 0.1 cm, about 0.2 cm, about 0.3 cm, about 0.4 cm, about 0.5 cm, about 1 cm, about 1.5 cm, about 2 cm, about 2.5 cm, or about 3 cm. The device can be manufactured to assume a single, continuous construction such as by injection molding, for example. The device can be of solid or hollow construction.

Figure 12:
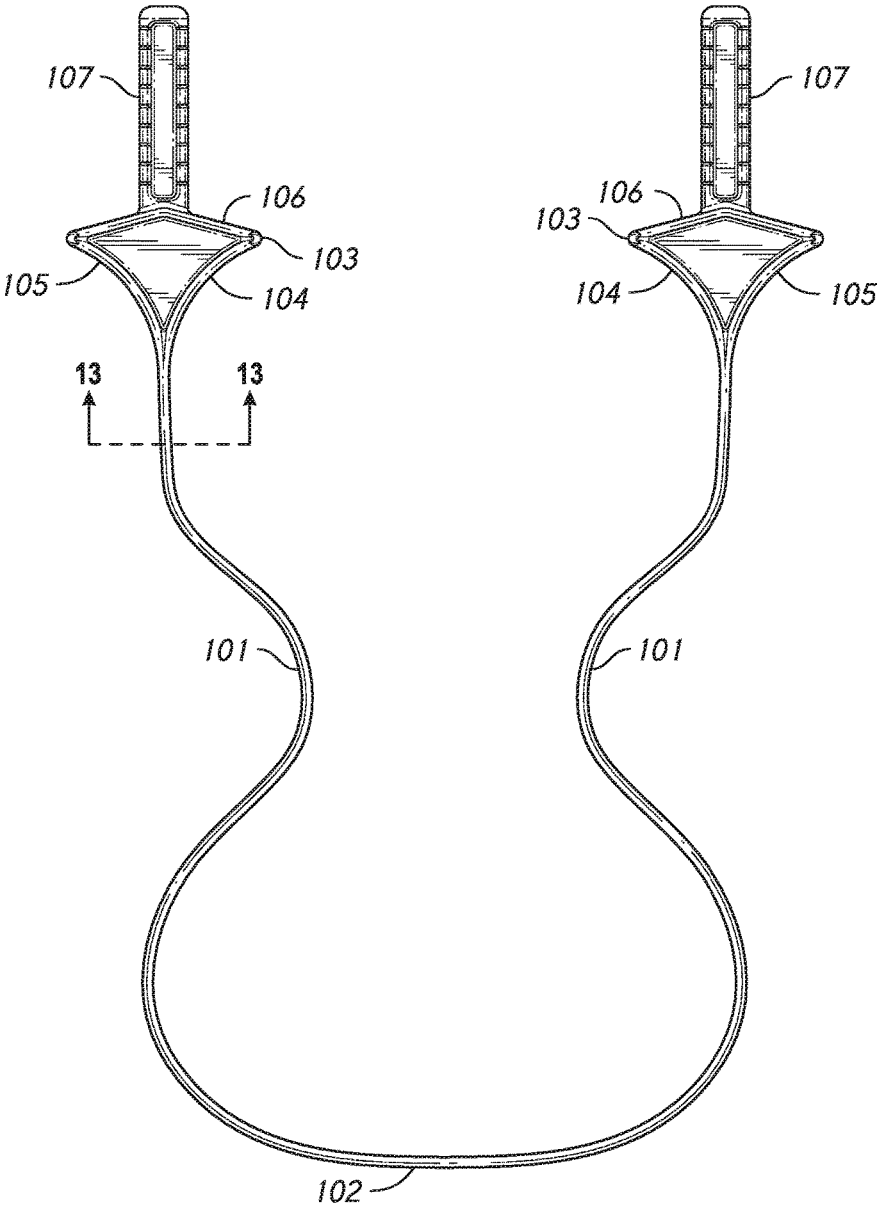
FIG. 12 is an elevational view of an embodiment of the inventive device in an unstressed state.
Figure 13:
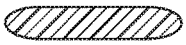
FIG. 13 is a sectional view taken along line 13-13 of FIG. 12.
Figure 14:
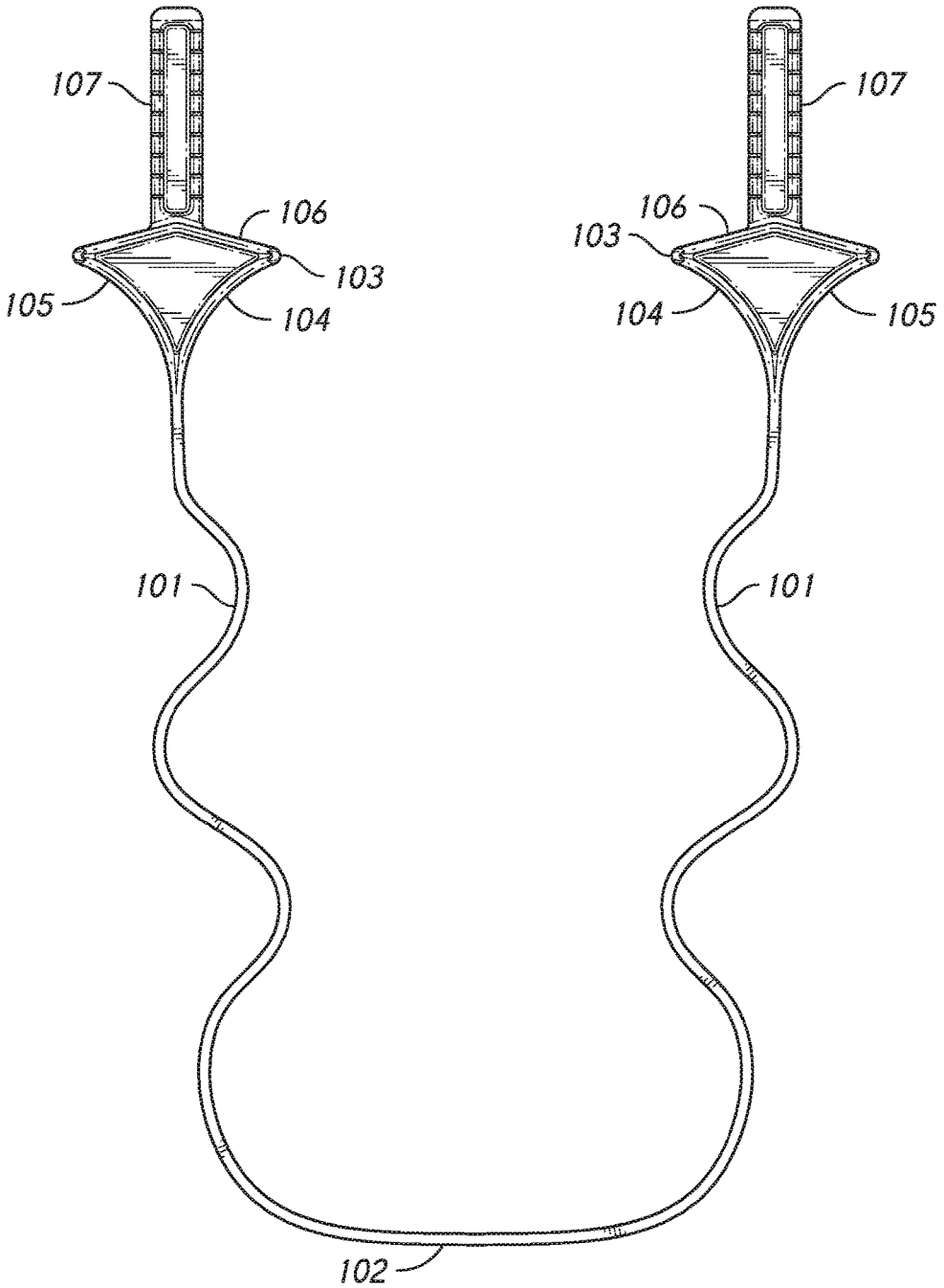
FIG. 14 is an elevational view of an embodiment of the inventive device in an unstressed state.
Figure 15:
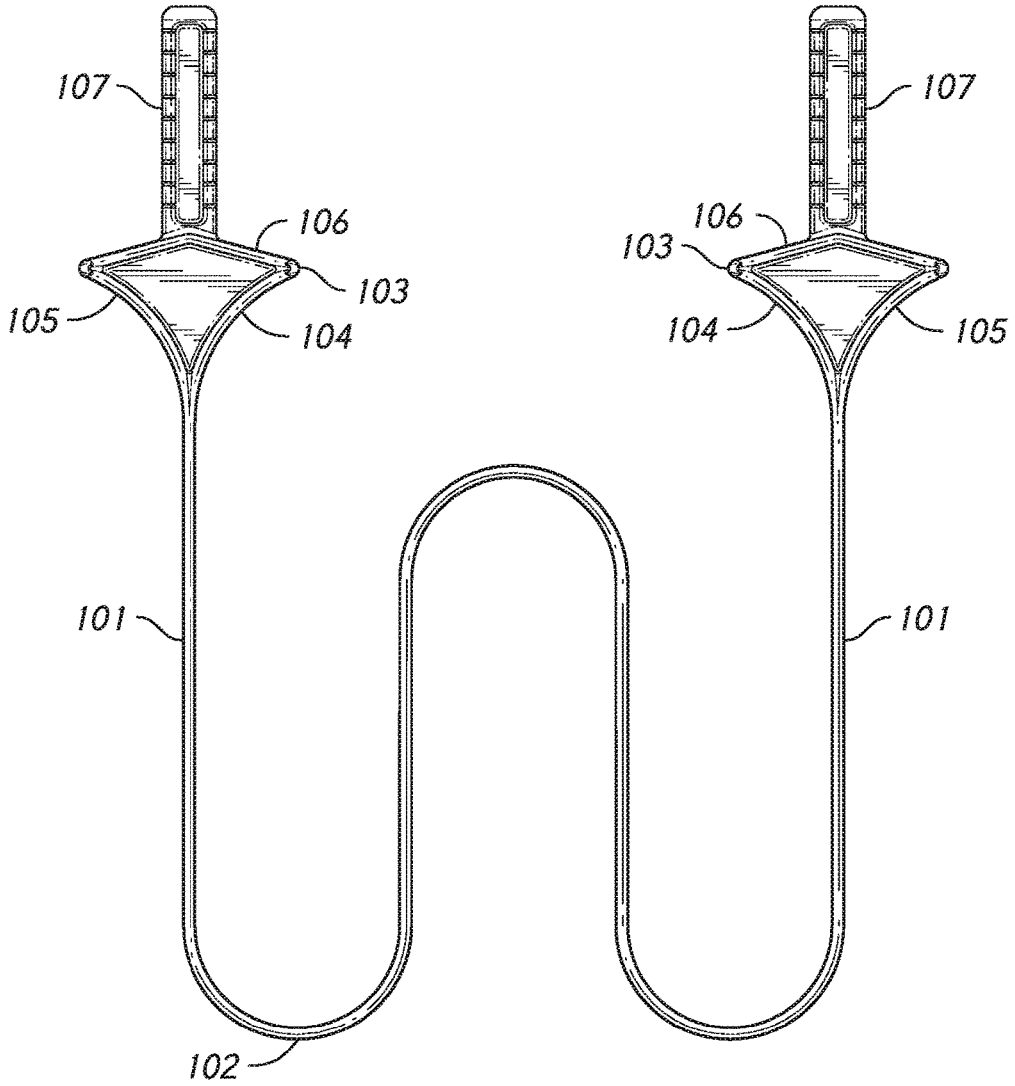
FIG. 15 is an elevational view of an embodiment of the inventive device in an unstressed state.
Figure 16:
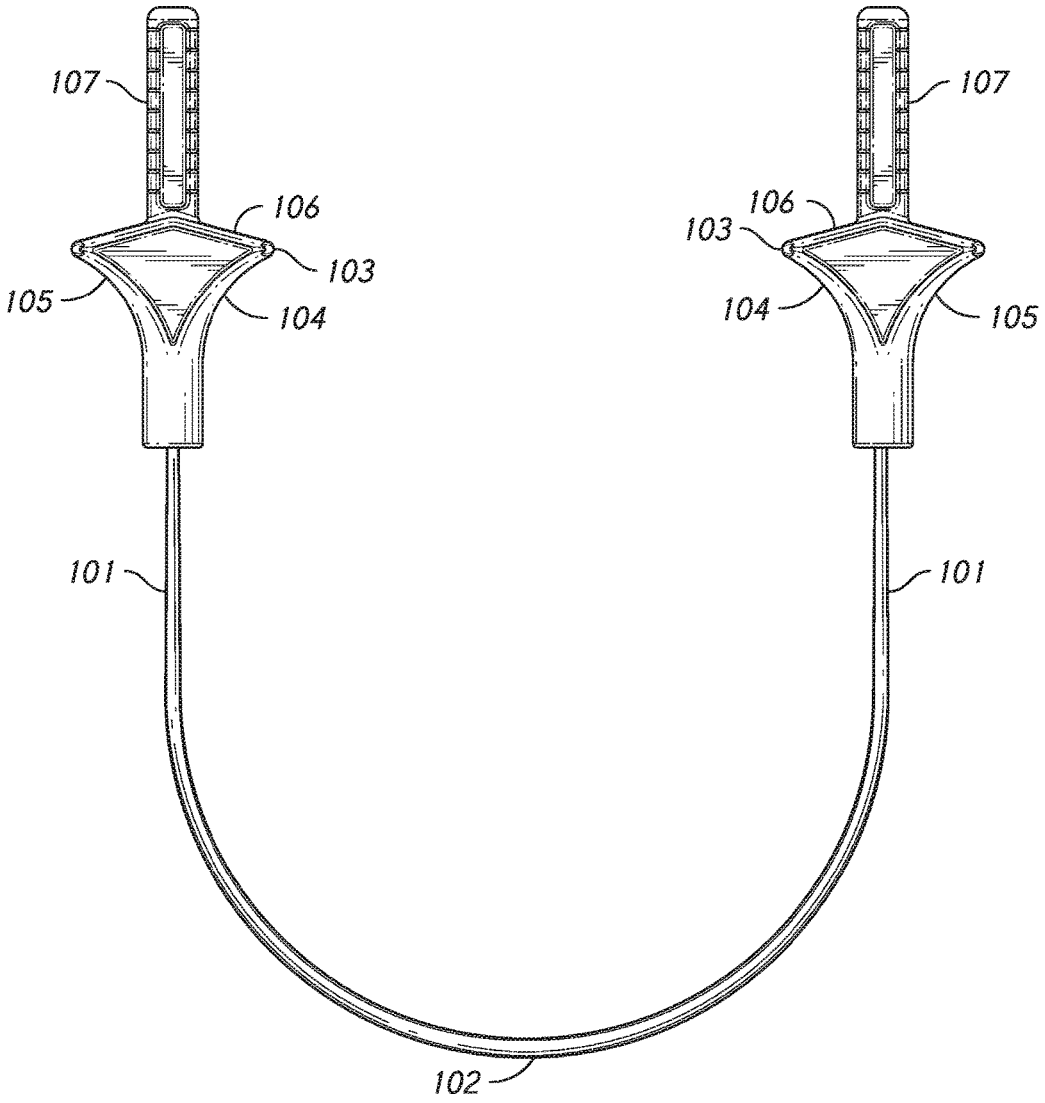
FIG. 16 is an elevational view of an embodiment of the inventive device in an unstressed state wherein the spring portion is fabricated from spring steel.
Figure 17:
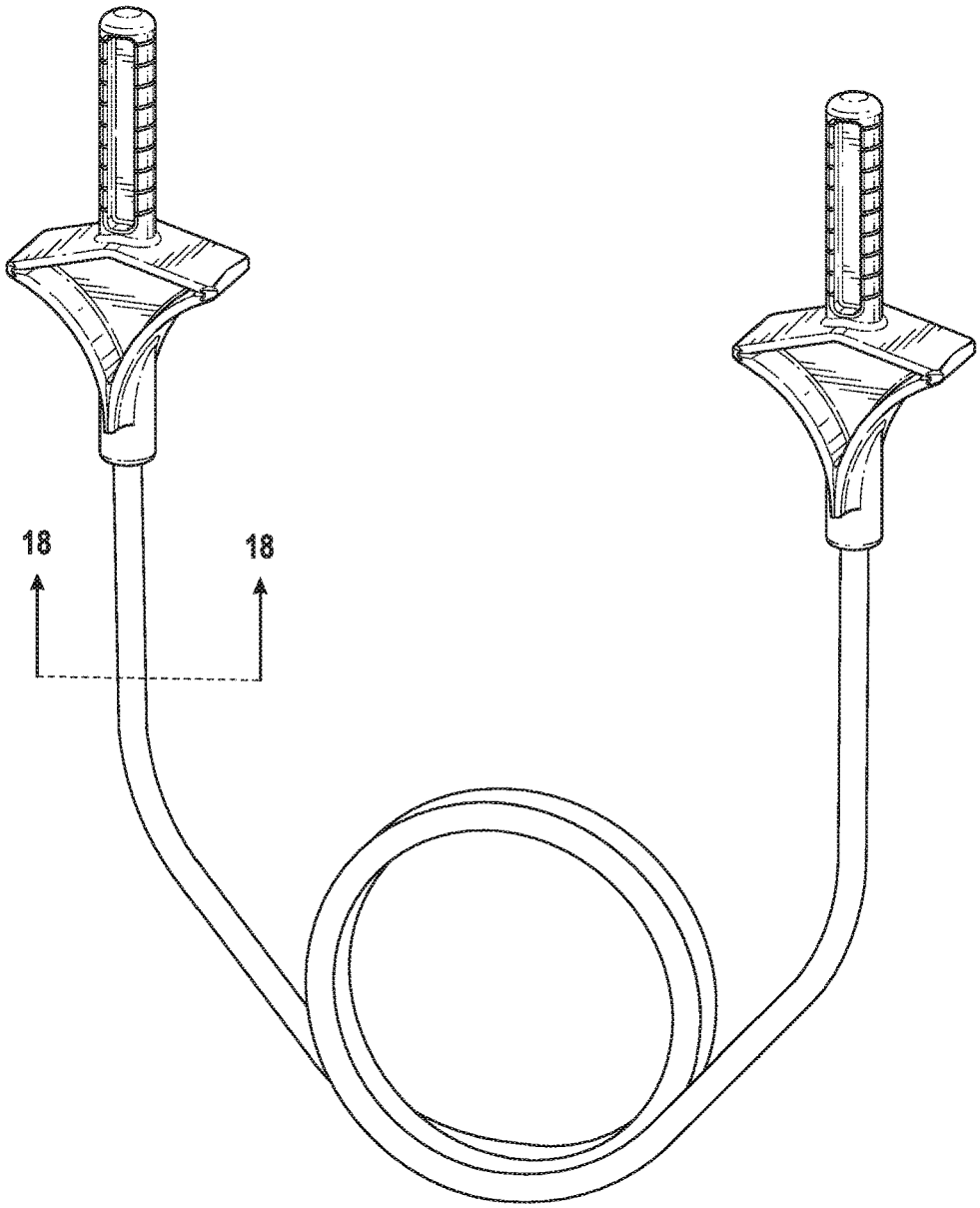
FIG. 17 is a perspective view of an embodiment of the inventive device that comprises a coil.
Figure 18:
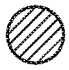
FIG. 18 is a sectional view taken along line 18-18 of FIG. 17.

Spring portion 102 can assume any shape that holds elongate members 101 in a generally parallel configuration and permits the spring portion to provide resistance to the movement of elongate members 101 towards and away from one another. Spring portion 102 can have a cross-section that is circular, square, or oblong. Spring portion 102 can have a cross-section that is rectangular or oval. Spring portion 102 can assume an arc such that the device assumes an overall U-shape when the device is in an unstressed state such as that depicted in FIG. 1, FIG. 2, FIG. 3, FIG. 4, FIG. 10, and FIG. 16, for example. Spring portion 102 can assume a shape having one or more arcs in an unstressed state, such as depicted in FIG. 15, for example. Spring portion 102, in an unstressed state, can assume a shape as depicted in FIG. 12 or FIG. 14. In yet another embodiment, spring portion 102 comprises a coil having at least one helical turn, such as depicted in FIG. 17, for example. The coil can have 1, 2, 3, 4, 5, 6, 7, 8, or more helical turns. In some embodiments where spring portion 102 comprises a coil, the entire device is manufactured from a synthetic material as disclosed herein. In other embodiments where spring portion 102 comprises a coil, the spring portion and elongate members 101 are manufactured from spring steel, while the remaining components of the device are manufactured from a synthetic material. Elongate members 101 and spring portion 102 manufactured from spring steel can have a cross-section that is circular or oval.

The device can be manufactured from a combination of components comprising spring steel and a synthetic material as disclosed herein. The synthetic material can be impregnated with glass fibers as disclosed herein. Non-limiting embodiments devices manufactured from a combination of components are depicted in FIG. 16 and FIG. 17, wherein elongate members 101 and spring portion 102 are manufactured from spring steel, and body engaging element 103 and handgrips 107 are manufactured from a synthetic material. Devices of the invention that are manufactured from a synthetic material and spring steel can be manufactured by molding the synthetic material components around the upper ends of the spring steel of elongate members 101. In some embodiments, steel elongate members 101 are attached to body engaging elements 103 by a fastener, such as screws, bolts and nuts, and/or rivets.

Figure 3:
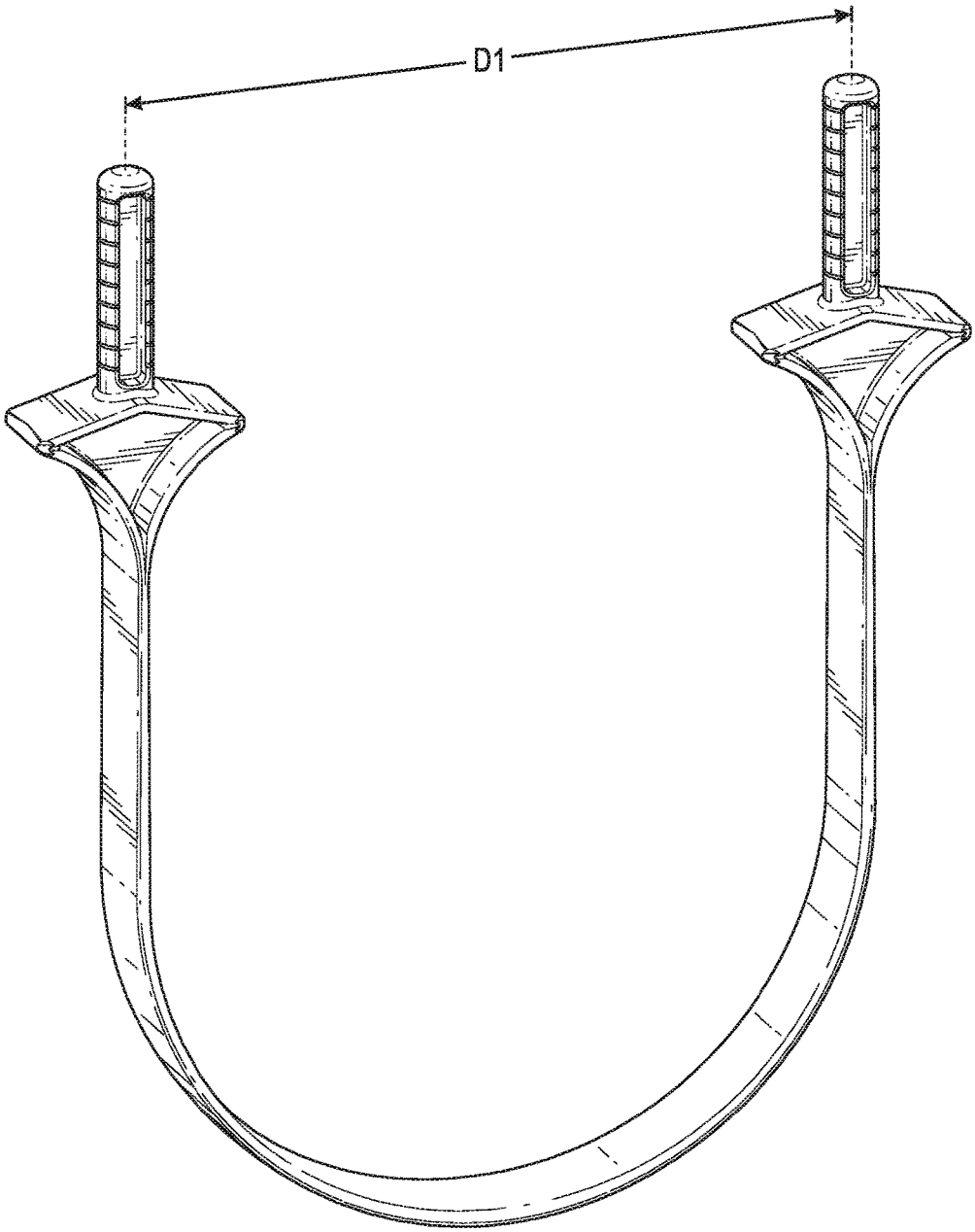
FIG. 3 is a perspective view of an embodiment of the inventive device showing a dimension of the device in an unstressed state.
Figure 4:
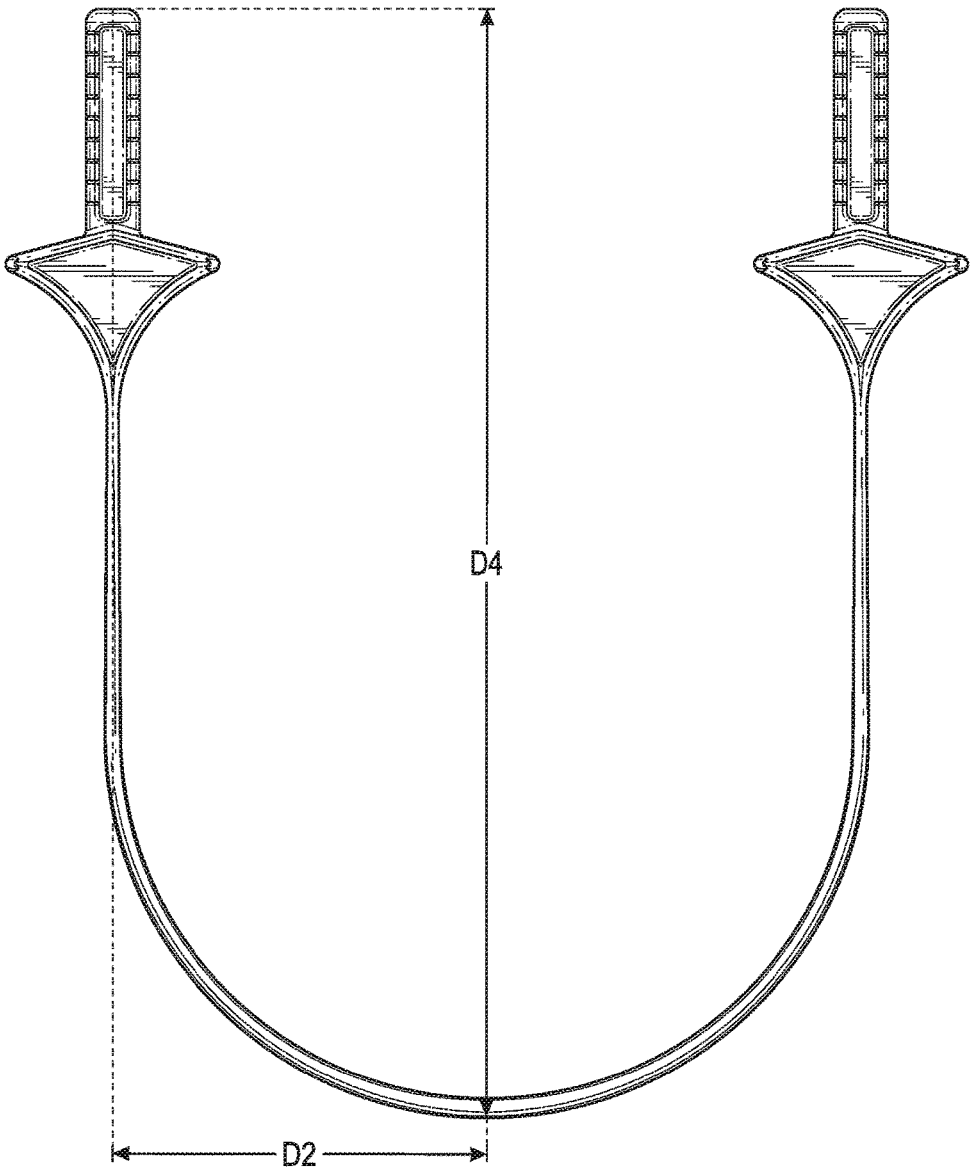
FIG. 4 is an elevational view of an embodiment of the inventive device showing dimensions of the device in an unstressed state.
Figure 5:
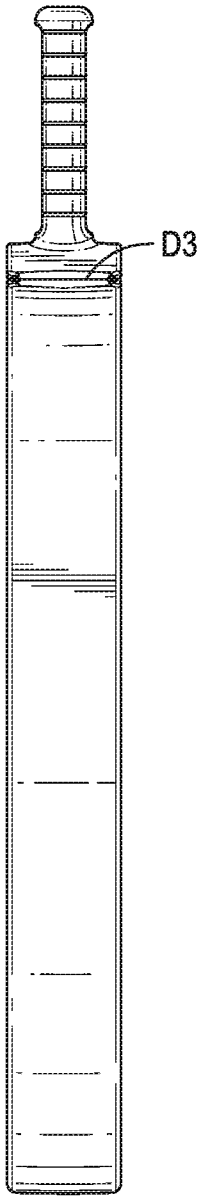
FIG. 5 is side view of an embodiment of the inventive device showing dimensions of the device in an unstressed state.
Figure 6:
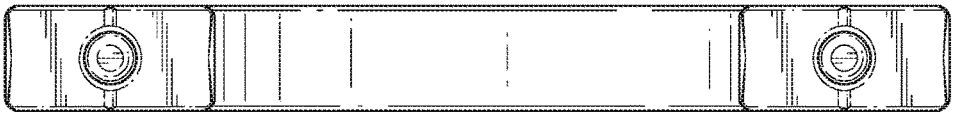
FIG. 6 is a top view of an embodiment of the inventive device in an unstressed state.
Figure 7:
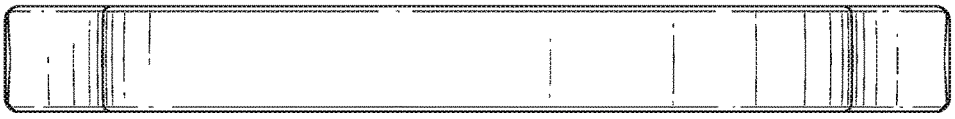
FIG. 7 is a bottom view of an embodiment of the inventive device in an unstressed state.
Figure 8:
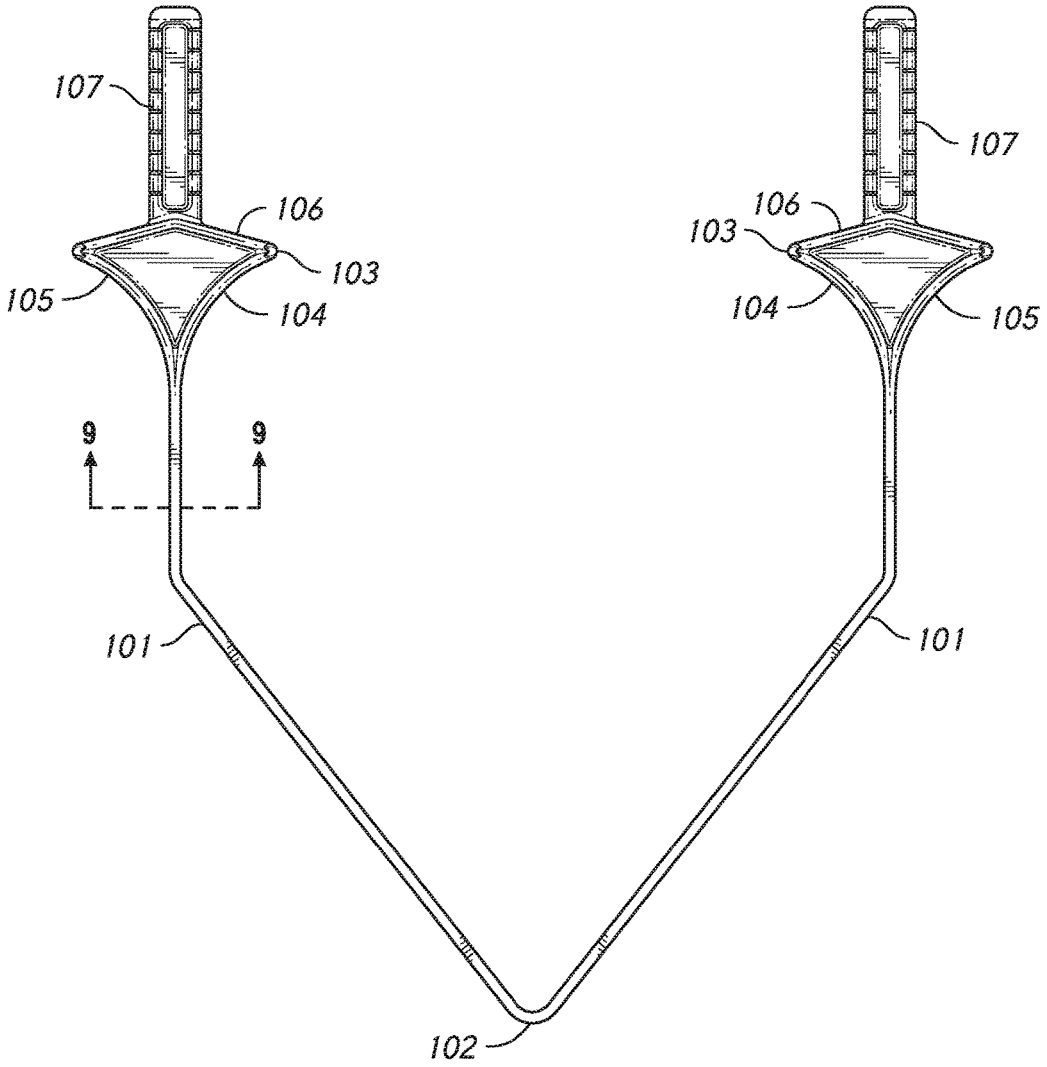
FIG. 8 is an elevational view of an embodiment of the inventive device in an unstressed state.
Figure 9:
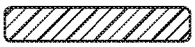
FIG. 9 is a sectional view taken along line 9-9 of FIG. 8.
Figure 10:
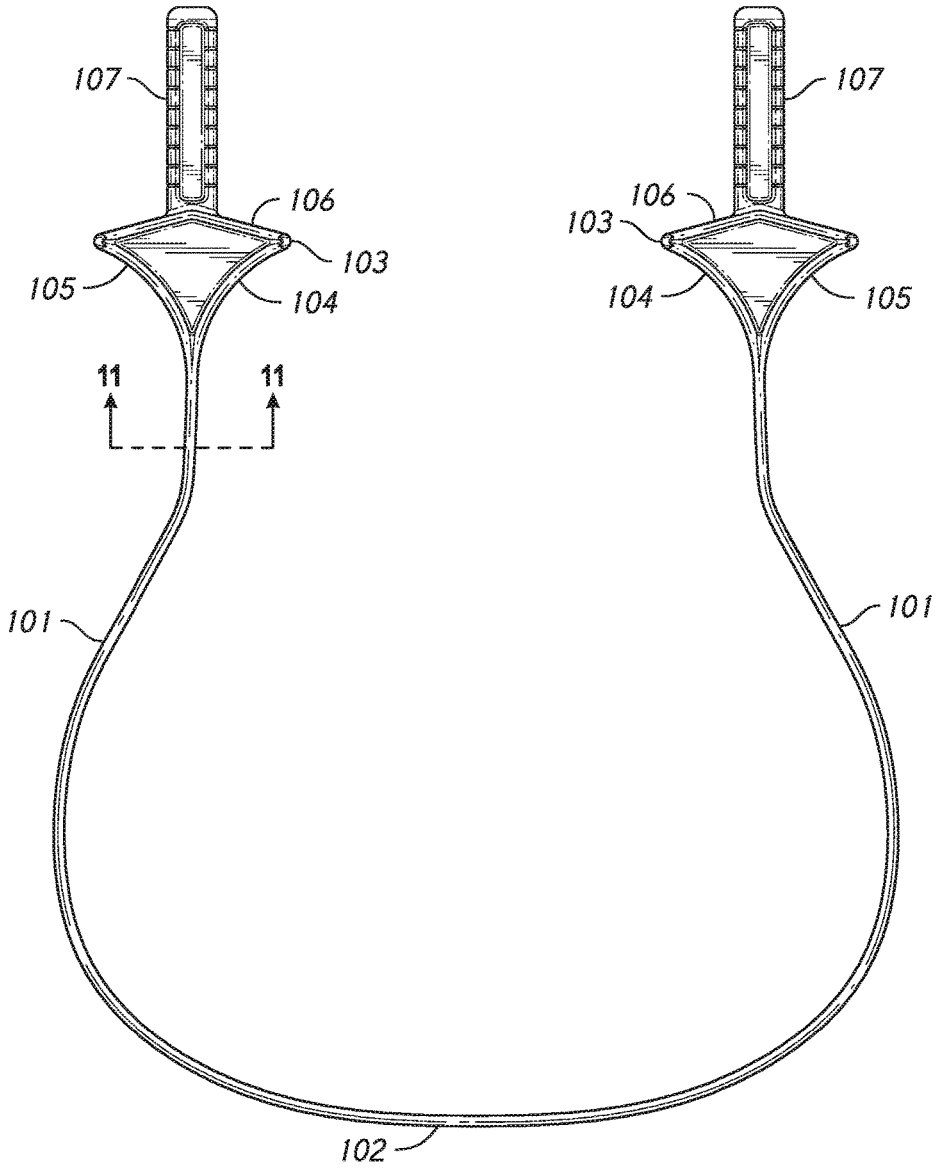
FIG. 10 is an elevational view of an embodiment of the inventive device in an unstressed state.
Figure 11:
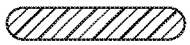
FIG. 11 is a sectional view taken along line 11-11 of FIG. 10.

The device can have any set of dimensions that permits it to be used for, perform the functions of, and assume the characteristics of, the device as disclosed herein. As depicted in FIG. 3, distance D1 between the central axis of elongate members 101 can be between about 10 inches and about 20 inches. Distance D1 can be about 10 inches, about 11 inches, about 12 inches, about 13 inches, about 14 inches, about 15 inches, about 16 inches, about 17 inches, about 18 inches, about 19 inches, or about 20 inches. In a preferred embodiment, distance D1 is about 14 inches. As depicted in FIG. 4, the device can assume a height D4. Height D4 can be between about 14 inches and about 30 inches. Height D4 can be about 14 inches, about 15 inches, about 16 inches, about 17 inches, about 18 inches, about 19 inches, about 20 inches, about 21 inches, about 22 inches, about 23 inches, about 24 inches, about 25 inches, about 26 inches, about 27 inches, about 28 inches, about 29 inches, or about 30 inches. Distance D1 and height D4 can be those dimensions disclosed herein, with or without handgrips 107. For example, height D4 can be the height of the device from the bottom of spring portion 102 to the top of body engaging element 103. As depicted in FIG. 5, the device can have a width D3 for each of elongate members 101, spring portion 102, and body engaging element 103. Width D3 can be between about 1 inch and about 5 inches. Width D3 can be about 1 inch, about 2 inches, about 3 inches, about 4 inches, or about 5 inches. In a preferred embodiment, width D3 is about 2 inches.

In at least one aspect, the device is used in methods of exercising. Such methods can be practiced by compressing elongate members 101 towards one another, and/or expanding elongate members 101 away from one another, against the resistance provided by at least one of elongate members 101 and spring portion 102. The device can be used in a method for exercising the inner thighs of a user. As depicted in FIGS. 19A-B, the device can be placed between the legs of the user so that outer surface 105 of body engaging element 103 receives the inner thighs of the user. The user then adducts his legs to compress elongate members 101 towards one another against the resistive force imparted by at least one of elongate members 101 and spring portion 102. In another embodiment, the user places outer surface 105 of body engaging element 103 against the inner calves or ankles of the user, then adducts his legs to compress elongate members 101 towards one another thereby exercising the inner thigh muscles of the user.

In another embodiment, the device is used in a method for exercising the outer thigh and hip muscles. As depicted in FIGS. 20A-B, the device can be placed on the outside thighs of the user so that inner surface 104 of body engaging element 103 receives the outer thighs of the user. The user then abducts his legs to expand elongate members 101 away from one another against the resistive force imparted by at least one of elongate members 101 and spring portion 102. In another embodiment, the user places inner surface 104 of body engaging element 103 against the outer calves or ankles of the user, then abducts his legs to expand elongate members 101 away from one another thereby exercising the outer thigh and hip muscles of the user.

In a further embodiment, the device is used in a method for exercising the chest, shoulder, back, arm and hand muscles. As depicted in FIGS. 21A-C, the user grips handgrips 107 in front of the chest of the user. The user then expands and/or compresses elongate members 101 away from and/or towards one another against the resistive force imparted by at least one of elongate members 101 and spring portion 102 thereby exercising the chest, shoulder, back, arm and hand muscles of the user. In an alternative embodiment, the user grips handgrips 107 in front of the abdomen of the user as depicted in FIGS. 22A-C. The user then expands and/or compresses elongate members 101 away from and/or towards one another against the resistive force imparted by at least one of elongate members 101 and spring portion 102 thereby exercising the chest, shoulder, back, arm and hand muscles of the user.

In yet another embodiment, the device is used in a method for exercising the shoulder, back, arm and hand muscles. As depicted in FIGS. 23A-C, the user grips handgrips 107 behind the lower back of the user. The user then expands and/or compresses elongate members 101 away from and/or towards one another against the resistive force imparted by at least one of elongate members 101 and spring portion 102 thereby exercising the shoulder, back, arm and hand muscles of the user.

In a further embodiment, the device is used in a method for exercising the chest, shoulder, back, arm and hand muscles. As depicted in FIGS. 24A-C, the user grips handgrips 107 over the head of the user. The user then expands and/or compresses elongate members 101 away from and towards one another against the resistive force imparted by at least one of elongate members 101 and spring portion 102 thereby exercising the chest, shoulder, back, arm and hand muscles of the user.

While specific forms of the invention have been illustrated and described in the foregoing specification and accompanying drawings, it should be understood that the invention is not limited to the exact construction shown, but that various alternatives in the construction and arrangement of parts, all falling within the scope and spirit of the invention, will be apparent to those skilled in the art. It will be understood that the device described herein may also find a useful application in other types of methods differing from those described above.

What is claimed is:

1. An exercise device comprising:

a) a pair of elongate members arranged parallel to one another and having a space therebetween wherein each of said elongate members has (i) an inner surface and an outer surface, (ii) a first protrusion, and (iii) a second protrusion, wherein said first protrusion extends from said inner surface towards said space and said second protrusion extends from said outer surface and away from said space; and b) a spring portion;

c) wherein said elongate members are joined by said spring portion to form a single, continuous body, wherein said device is generally u-shaped when said spring portion is in an unstressed state.

2. The exercise device of claim 1, wherein at least one of (i) said elongate members, and (ii) said spring portion are resilient and provide resistive force against movement of said pair of elongate members towards and away from one another.

3. The exercise device of claim 1, wherein each of said protrusions is configured to receive the thigh of a user.

4. The exercise device of claim 1, wherein each of said protrusions is in the shape of an arc.

5. The exercise device of claim 4, wherein said arc has a top end and a bottom end, wherein said top end protrudes from the first or second surface of the elongate member from which the protrusion extends and said bottom end is generally flush with the first or second surface of the elongate member from which the protrusion extends.

6. The exercise device of claim 1, wherein said spring portion has the shape of an arc when said spring portion is in an unstressed state.

7. The exercise device of claim 1, wherein at least one of said spring portion and said elongate members is round or oblong in cross-section.

8. The exercise device of claim 1, wherein at least one of said spring portion and said elongate members is rectangular or oval in cross-section.

9. The exercise device of claim 1, wherein each of said elongate members includes an elongate handle portion above said protrusions.

10. The exercise device of claim 9, wherein said first protrusion and said second protrusion form an abutment configured to support the hand of a user when the user's hand engages said elongate handle portion.

11. The exercise device of claim 9, wherein said elongate handle portion is circular, oval or generally hour glass in cross-section.

12. The exercise device of claim 1, wherein said exercise device is fabricated from a material selected from the group consisting of polyvinyl chloride (PVC), acrylonitrile-butadiene-styrene (ABS), polypropylene, and nylon.

13. The exercise device of claim 12, wherein said material is reinforced with glass fibers.

14. The exercise device of claim 13, wherein said material contains about 10% to about 50% of said glass fibers by weight.

15. The exercise device of claim 13, wherein said material contains about 20% to about 40% of said glass fibers by weight.

16. A method for exercising the muscles of a user, said method comprising:

a. providing an exercise device according to claim 1;

b. contacting said exercise device with the body of a user; and c. compressing or expanding by said user at least one of said spring portion and said elongate members thereby exercising the muscles of said user.

17. The method of claim 16, wherein said second protrusion is contacted with the inner thigh of said user and compressing comprises adducting the legs of said user thereby exercising the inner thigh muscles of said user.

18. The method of claim 16, wherein said first protrusion is contacted with the outer thigh of said user and expanding comprises abducting the legs of said user thereby exercising the outer thigh muscles and hips of said user.

19. The device of claim 1, wherein said elongate members are planar and said inner surface and said outer surface are flat.

20. An exercise device comprising:

a) a pair of planar elongate members arranged parallel to one another and having a space therebetween wherein each of said elongate members has (i) an elongate handle, (ii) a flat inner surface and a flat outer surface, (iii) a first protrusion, and (iv) a second protrusion, wherein said first protrusion extends from said inner surface towards said space and said second protrusion extends from said outer surface and away from said space; and b) a spring portion;

c) wherein said elongate members are joined by said spring portion such that said device is generally u-shaped when said device is in an unstressed state;

d) wherein said device is a single, continuous body.

* * * * *